United States Patent [19]

Fox et al.

[11] Patent Number: 4,695,029

[45] Date of Patent: Sep. 22, 1987

[54] SUPPORT DEVICE FOR SECURING A RAZOR TO A SHAVING CREAM DISPENSER

[76] Inventors: Jeffrey A. Fox, 4374 Ventura Canyon Ave., #5, Sherman Oaks, Calif. 91403; Cheryl Fox, 3274 Ventura Canyon Ave., #5, Sherman Oaks, Calif. 91403

[21] Appl. No.: 816,934

[22] Filed: Jan. 8, 1986

Related U.S. Application Data

[63] Continuation-in-part of Ser. No. 690,927, Jan. 11, 1985, abandoned.

[51] Int. Cl.[4] ..... A47G 29/00

[52] U.S. Cl. ..... 248/360; 248/309.1; 248/231

[58] Field of Search ..... 248/360, 231, 359 R, 248/359 F, 316.1, 316.7, 309.1, 359 G; 24/339, 335; 220/85 P; 206/821; 222/545, 567, 182

[56] References Cited

U.S. PATENT DOCUMENTS

| | | | |
|---|---|---|---|
| 2,864,510 | 12/1958 | Sture | 220/85 R |
| 2,970,720 | 2/1961 | Dooley, Jr. | 220/85 D |
| 3,180,537 | 4/1965 | Collins | 206/821 X |
| 3,272,323 | 9/1966 | Ewry | 220/85 R X |
| 3,486,630 | 12/1969 | Ellman | 220/85 R X |
| 3,624,789 | 11/1971 | Peyser | 206/821 X |
| 4,141,445 | 2/1979 | Korich | 220/85 R X |
| 4,232,785 | 11/1980 | Lucas | 220/85 R X |
| 4,314,576 | 2/1982 | Murphy et al. | 220/85 P X |

*Primary Examiner*—Ramon S. Britts
*Assistant Examiner*—Karen J. Chotkowski
*Attorney, Agent, or Firm*—Nilsson, Robbins, Dalgarn, Berliner, Carson & Wurst

[57] ABSTRACT

An adapter for securing a cosmetic implement to a cosmetic dispensing unit, such as a razor secured to a shaving cream can, is made by positioning a snap-on supporting body or collar of unitary construction around the top of the dispensing unit. The collar includes a flange having a radial extension which defines an opening therethrough to receive the handle of the razor. The collar also includes a longitudinally extending ridge which receives the snap-on cap which comes with the shaving cream dispenser. Alternatively the ridge may be extended to form an integrally formed member to replace the cap which normally covers the can.

5 Claims, 9 Drawing Figures

FIG. 1
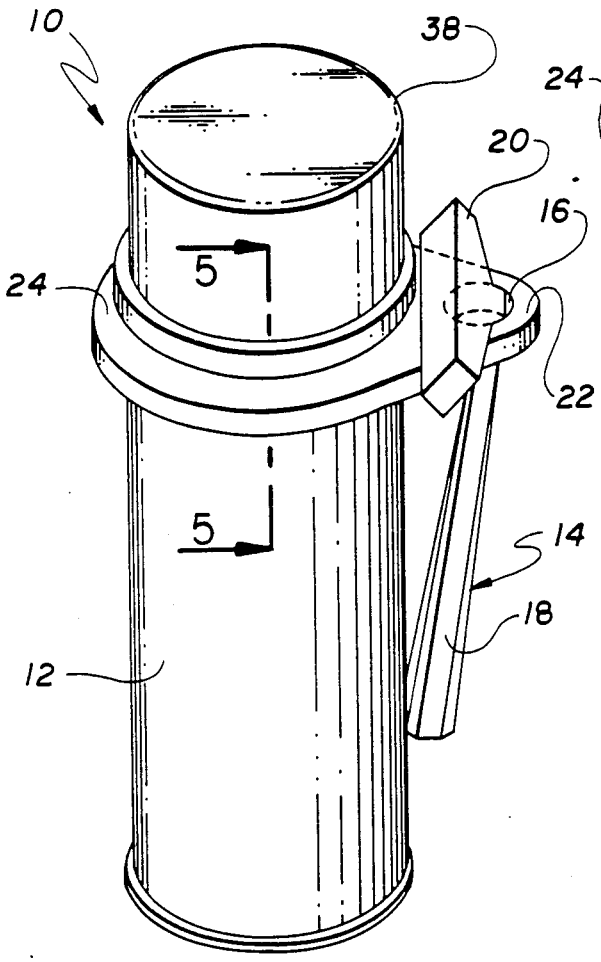
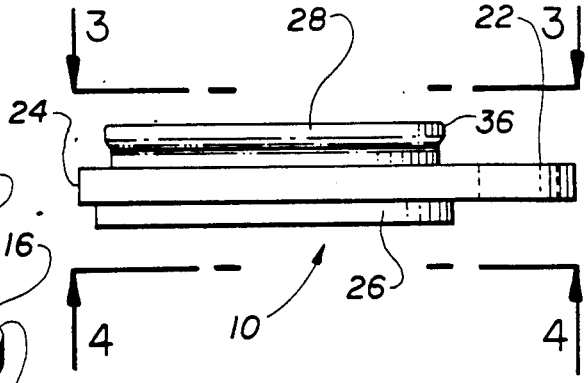
FIG. 2
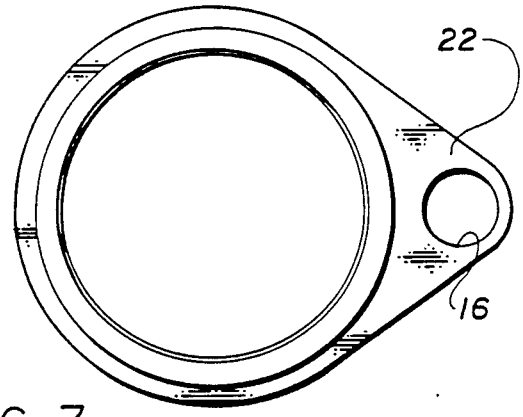
FIG. 3
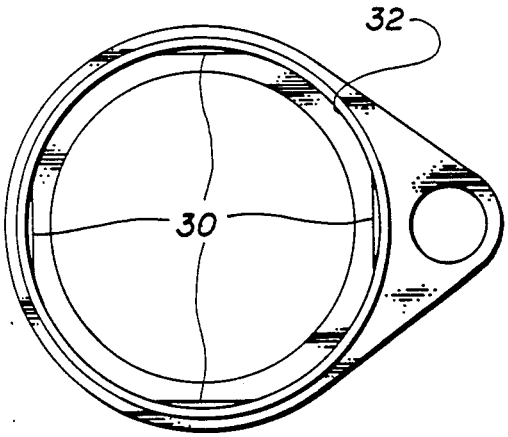
FIG. 4
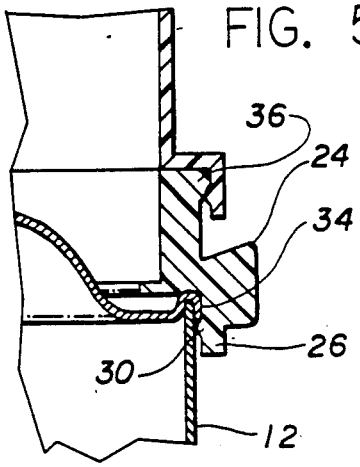
FIG. 5

FIG. 6
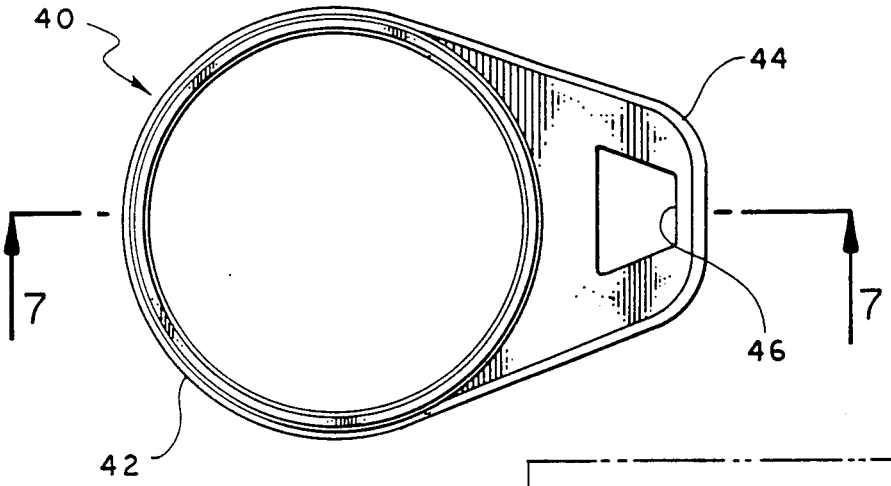
FIG. 7
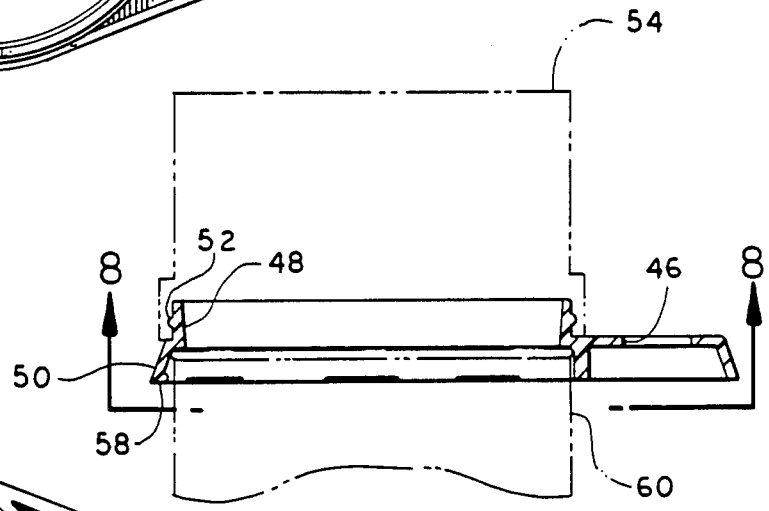
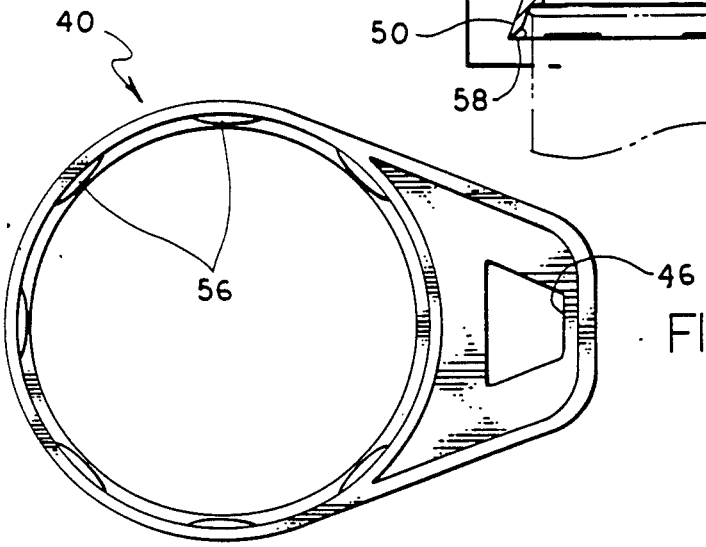
FIG. 8
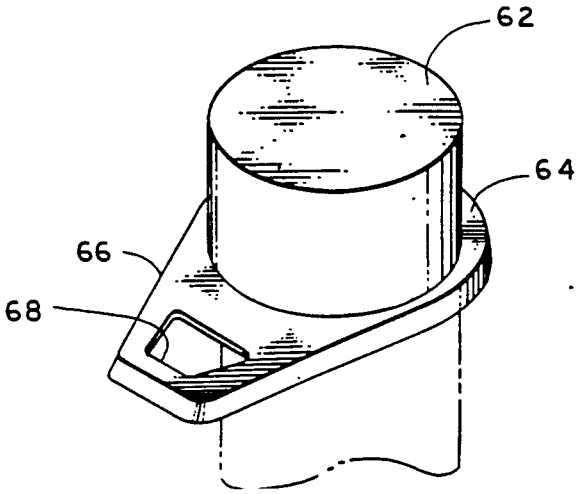
FIG. 9

SUPPORT DEVICE FOR SECURING A RAZOR TO A SHAVING CREAM DISPENSER

RELATED APPLICATION

This application is a continuation-in-part of application Ser. No. 690,927 filed Jan. 11, 1985.

FIELD OF THE INVENTION

This invention relates to an adapter for attachment to a cosmetic dispensing unit, the adapter serving to secure a cosmetic implement in proximity to the dispensing unit. More specifically this invention relates to a snap-on collar or cap having a flange having an opening so that a shaving implement such as a razor is retained adjacent a shaving cream dispenser.

BACKGROUND OF THE INVENTION

The modern household contains a wide variety of health and beauty aids. Many of these products are stored for use in the dressing room or bath area of the house. A number of these products are stored in aerosol or pump dispenser cans or tubes. Certain beauty and health related products are used in a set, such as a toothbrush and toothpaste, a make-up case and make-up, nail polish and a nail polish brush, and a shaving cream dispenser and razors.

Many of these products are traditionally kept in an organized storage location in close proximity to each other, much as a workman keeps his tools organized in a tool box. In practice, shaving cream dispensers have not necessarily been stored in conjunction with the razor. As the size of today's home is customized, creating living quarters that are close, married couples and families often share the same dressing room and washing facilities. It is not uncommon for members of the family to each use the same shaving cream and razor. This multiple use can lead to a misplacing of either the shaving cream or the razor at times when their simultaneous use is required.

In the past, attempts have been made to provide storage for household cosmetics. U.S. Pat. No. 390,089, to McClelland, discloses a metallic band surrounding a toiletries carrying case. A metal clip protrudes from within the case along a band for holding implements such as a toothbrush. The band fits loosely around the case and is fitted with a lateral supporting spring. The lateral supporting spring is a cutter clip which is used to support the band and cut the toiletry case in half. (The band is of a complicated design enveloping the implement holding clip.)

Ewry, U.S. Pat. No. 3,272,323, and Slewing, U.S. Pat. No. 3,426,769, attempt to secure a razor to an aerosol container by means of a specially fabricated molded plastic collar (Ewry), or an auxiliary recess on the side of the container (Slewing). These patents, along with Lucas, U.S. Pat. No. 4,232,785, have specially molded protective covers or recesses on the side of the container which secure the shaving implement to the side of the shaving cream can. The patents all disclose a costly fabricated implement holder. The securing means shown in these patents are specially fabricated for securing a limited variety of razors to the side of the dispensing can.

U.S. Pat. No. 3,486,630 to Ellman, discloses a flat plate collar with a variety of implement storage and securing compartments. This collar again presents a costly fabrication problem and requires the rim of the container for support in order to maintain the implement holder in a stable position.

U.S. Pat. No. 3,823,814, to Lum, discloses an elastic band which is disposed around a larger object, stitched to a second smaller elastic band which secures a smaller but related object to the side of the larger object, such as securing a cassette tape to the side of a book. This double loop construction may be useful in conjunction with the storage of audio-visual material, but for the organizing and easy securement of toiletries which are constantly used and reused, the elastic band is too awkward and may not be strong enough to withstand repeated use. Furthermore, the two piece construction is not suitable as a means for securing a razor to a shaving cream can.

Other securement means for secondary consideration are U.S. Pat. Nos. 3,667,646 and 3,675,814, both to Graf, for an auxilaiary carrier strapped to a lunchbox. Likewise, U.S. Pat. No. 4,436,217, to Rittner, shows a paint brush support vessel.

Thus, the conventional art illustrates an attempt to organize related objects by securing them together either by means of multipart construction adapters such as Lum or Graf, or special purpose securement covers for a shaving cream can which pose costly fabrication problems.

What is needed is an adapter which may be used to secure a razor blade or other cosmetic implement to a shaving cream can or other cosmetic dispensing unit in a low cost and simple manner. The retainer means of the adapter must be of unitary construction and useful in conjunction with the standard dispensers.

SUMMARY OF THE INVENTION

The present invention is an adapter for attachment to a cosmetic dispensing unit for the orderly storage of a cosmetic implement, such as the storage of a razor in conjunction with a shaving cream can. A retainer means snaps onto the cosmetic dispensing unit and is a body of unitary construction. The means for holding the cosmetic implement is integrally molded with the body for receiving the cosmetic implement. In such a manner, one can quickly remove the razor from its holder along the sides of the shaving cream can and place it back when one is through shaving.

BRIEF DESCRIPTION OF THE DRAWINGS

FIG. 1 is a perspective view of a preferred embodiment of a support device for securing a razor to a shaving cream dispenser;

FIG. 2 is a side elevational view of the adapter of the invention;

FIG. 3 is a plan view of the adapter taken at lines 3—3 of FIG. 2;

FIG. 4 is a bottom view of the adapter taken at lines 4—4 of FIG. 2;

FIG. 5 is a cross sectional view showing the adapter in place on a dispenser and is taken about lines 5—5 of FIG. 1;

FIG. 6 is a top view of an alternative embodiment of the device;

FIG. 7 is a cross sectional view taken about the lines 7—7 of FIG. 6;

FIG. 8 is a bottom view taken about the lines 8—8 of FIG. 7; and

FIG. 9 is a perspective view of another alternative embodiment of a device constructed in accordance with the principles of the present invention.

DETAILED DESCRIPTION OF THE PREFERRED EMBODIMENT

Referring to FIG. 1, the support device adapter for securing a cosmetic implement to a cosmetic unit, such as a razor secured to the side of a shaving cream can is shown generally at 10, snapped onto a container 12. The razor is received within an opening 16 through which the handle 18 fits while the blade portion 20 supports the razor 14 upon the extended flange 22 formed as part of the collar 24 of the adapter 10.

The collar 24 may be molded from any plastic material, such as organic polymers. The collar 24 is constructed so that it may easily snap on and off the cosmetic dispensing container 12; but, while it is in use on the container 12, it is sufficiently secure to support the razor 14 adjacent the container 12.

As is more clearly shown in FIGS. 2 through 5, the adapter 10 is a molded unitary member including the collar 24 and a lower rim 26 and an upper rim 28. The lower rim 26 includes a plurality of protrusions 30 extending inwardly from the inner surface 32 thereof. The protrusions 30 cooperate with a bead 34 which extends around the upper periphery of the container 12 to thereby permit the lower rim 26 to snap onto the top of the container 12 and thereby secure the adapter 10 firmly in place upon the container 12.

The upper rim 28 includes a bead 36 which extends outwardly therefrom to receive the cap 38 which normally seats upon the container 12.

From this construction it is apparent that the adapter 10 may be utilized by removing the cap 38 from the container 12, snapping the adapter 10 in place upon the top of the container 12 and then re-applying the cap 38 which is secured in place upon the adapter 10. The opening 16 may then be utilized to receive the razor 14 by placing the handle 18 through the opening 16.

It will become apparent to those skilled in the art that the container 12 may be utilized in the normal fashion by removing the cap 38 from the adapter 10 as if the adapter 10 were not snapped in place upon the container 12.

It will also become apparent that the adapter 10 may be moved from container to container and continuously used as each container content is emptied.

Referring now more particularly to FIGS. 6 through 8, there is illustrated an alternative embodiment of a support device adapter constructed in accordance with the principles of the present invention. As is therein shown the adapter 40 is constructed of a longitudinally extending cylindrical member 42 having a bill 44 extending outwardly therefrom and defining an opening 46 therethrough to receive the implement such as a razor as described above. The rim 42 contains offset flanges 48 and 50. The flange 48 includes a bead 52 for receiving the cap 54 which originally came with the shaving cream or other container. The flange 50 includes a plurality of inwardly directed protrusions 56 at the lowermost edge 58 thereof which may be snapped over the top of the can 60 as above described for holding the device in place and for permitting transference of the device from can to can.

Alternatively, as is shown in FIG. 9, the supporting device constructed in accordance with the present invention may include an integrally formed cap 62 and rim 64 having a bill 66 defining an opening 68 therein. Under utilization of a structure as shown in FIG. 9, the original cap which would come with the can of shaving cream would be discarded and the device as shown in FIG. 9 would be substituted.

It should be noted that the embodiments contained in this detailed description are merely illustrative of an adapter support device for securing a razor to a shaving cream dispenser. The scope of the invention is not necessarily limited to the preferred embodiment. Many structural changes are possible and those changes are intended, to be within the scope of his disclosure. Consequently, the specific structural functional details of the adapter support device are merely representative yet they are deemed to afford the best embodiment for purposes of disclosure and for providing support for the claims which define the scope of the present invention.

What is claimed is:

1. An adapter for attachment to a cosmetic dispensing unit having a peripheral bead for receiving a cap, said adapter comprising:
   - a collar member having a radially outwardly extending flange defining an opening therethrough,
   - first and second rims extending in opposite longitudinal directions from said collar member;
   - first means carried by said first rim for removably affixing said collar member to said peripheral bead on said dispensing unit; and
   - second means carried by said second rim for removably securing the cap.

2. The adapter as defined in claim 1 wherein said first means includes a plurality of inwardly extending protrusions which slip over said bead.

3. The adapter as defined in claim 1 wherein said second means includes an outwardly extending peripheral ridge.

4. The adapter as defined in claim 3 wherein said first means includes a plurality of inwardly extending protrusions which slip over said bead.

5. The adapter as defined in claim 1 wherein said body includes a radially inwardly extending shoulder displaced from said first means for limiting the movement of said body relative said bead.

* * * * *